US010774537B2

(12) United States Patent
Folkersen et al.

(10) Patent No.: US 10,774,537 B2
(45) Date of Patent: Sep. 15, 2020

(54) DOUBLE COVERAGE ROOF WALL FLASHING WITH CAVITY

(71) Applicant: Roofers' Advantage Products LLC, E. Wakefield, NH (US)

(72) Inventors: Jonny E. Folkersen, East Wakefield, NH (US); Benjamin J. Folkersen, East Wakefield, NH (US)

(73) Assignee: Roofers' Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 16/355,270

(22) Filed: Mar. 15, 2019

(65) Prior Publication Data

US 2019/0284814 A1 Sep. 19, 2019

Related U.S. Application Data

(60) Provisional application No. 62/659,757, filed on Apr. 19, 2018, provisional application No. 62/643,335, filed on Mar. 15, 2018.

(51) Int. Cl.
*E04D 13/15* (2006.01)
*E04D 13/14* (2006.01)

(52) U.S. Cl.
CPC ..... *E04D 13/15* (2013.01); *E04D 13/14* (2013.01)

(58) Field of Classification Search
CPC ..... E04D 13/15; E04D 13/14; E04D 13/12
See application file for complete search history.

(56) References Cited

U.S. PATENT DOCUMENTS

| | | | | |
|---|---|---|---|---|
| 1,685,525 | A | | 9/1928 | Dow |
| 1,860,240 | A | | 5/1932 | Friedrich |
| 3,243,926 | A | | 4/1966 | Keyt |
| 3,415,020 | A | | 12/1968 | Windle |
| 3,436,877 | A | | 6/1969 | Gunning |
| 4,254,594 | A | | 3/1981 | Hammond |
| 4,332,117 | A | | 6/1982 | Quinnell |
| 4,594,820 | A | | 6/1986 | Render |
| 4,665,667 | A | | 5/1987 | Taylor |
| 4,780,997 | A | | 11/1988 | Taylor |
| 4,780,999 | A | * | 11/1988 | Webb ..... E04D 13/155 52/60 |
| 5,065,553 | A | * | 11/1991 | Magid ..... E04D 13/1407 52/409 |
| 5,109,641 | A | | 5/1992 | Halan |
| D342,326 | S | | 12/1993 | Hansson |
| 5,328,406 | A | | 7/1994 | Morris, Jr. |
| 5,337,526 | A | | 8/1994 | Hartman |
| D354,733 | S | | 1/1995 | Ingraham |
| 5,522,189 | A | * | 6/1996 | Mortensen ..... E04D 13/02 52/200 |
| 5,586,414 | A | | 12/1996 | Tawzer |
| D422,095 | S | | 3/2000 | Thagard, III et al. |
| 6,035,587 | A | | 3/2000 | Dressler |

(Continued)

*Primary Examiner* — Paola Agudelo
(74) *Attorney, Agent, or Firm* — Maine Cernota & Rardin

(57) ABSTRACT

Roof-to-wall flashing having a cavity formed from a closed hem that permits for the installation of new flashing into the cavity when installing a second layer roof, without removing the existing wall flashing and siding. The ledge acts like a hinge or spring which becomes compressed once siding or exterior product is placed onto ledge. The hinge or spring-like effect compresses the cavity, assisting in holding second layer flashings in place.

12 Claims, 2 Drawing Sheets

(56) References Cited

U.S. PATENT DOCUMENTS 6,186,605 B1 2/2001 Nelson
D438,650 S 3/2001 Neuhofer, Jr.
D452,918 S 1/2002 Ohanesian
6,715,237 B2 4/2004 Batt, Sr.
6,780,099 B1 8/2004 Harper
6,848,220 B2 2/2005 Faurholdt
6,880,302 B1 4/2005 Fontaine
7,451,572 B1 11/2008 Inzeo
7,546,719 B1 6/2009 Guevara
7,941,989 B2 * 5/2011 Morsching ..... E04D 13/15 248/124.1
8,281,521 B1 10/2012 Rasmussen
8,316,587 B2 * 11/2012 Shugart ..... E04D 13/158 52/60
8,739,470 B1 * 6/2014 Wayne ..... E04D 13/15 52/58
8,869,466 B2 10/2014 Garcia
9,200,450 B2 12/2015 Thagard, III
9,394,693 B2 7/2016 Daniels
9,650,787 B2 5/2017 Montojo
10,000,930 B2 6/2018 Lowe
10,036,166 B1 7/2018 Heo
10,125,497 B2 11/2018 Givens
D844,182 S 3/2019 Folkersen
2002/0178671 A1 * 12/2002 Gembala ..... E04D 3/405 52/302.6
2004/0016201 A1 1/2004 Folkersen
2004/0103592 A1 * 6/2004 Edvardsen ..... E04D 13/04 52/58
2005/0005551 A1 1/2005 Graham
2005/0086873 A1 * 4/2005 Mares ..... E04D 13/1478 52/58
2006/0016130 A1 1/2006 Lin
2006/0254169 A1 11/2006 McFadden
2007/0074466 A1 4/2007 Rasmussen
2007/0266657 A1 * 11/2007 Gembala ..... E04D 13/15 52/288.1
2008/0005975 A1 * 1/2008 Thompson ..... E04B 1/003 52/62
2010/0300011 A1 * 12/2010 Crego ..... E04D 3/365 52/60
2011/0049118 A1 3/2011 Nark
2012/0102849 A1 5/2012 Shugart
2017/0226741 A1 * 8/2017 Givens ..... E04D 13/15
2018/0066436 A1 * 3/2018 Stiglmayr ..... E04D 13/15
2018/0223537 A1 8/2018 Bredeweg
2018/0347197 A1 12/2018 Folkersen
2019/0284810 A1 9/2019 Folkersen
2019/0284814 A1 9/2019 Folkersen

* cited by examiner

DOUBLE COVERAGE ROOF WALL FLASHING WITH CAVITY

RELATED APPLICATIONS

This application claims the benefit of U.S. Provisional Applications Nos. 65/659,757, filed Apr. 19, 2018, and 60/643,335, filed Mar. 15, 2018. Each of these applications is herein incorporated by reference, in its entirety, for all purposes.

FIELD OF THE INVENTION

The invention relates roofing, and, more particularly, to flashing used in roof applications.

BACKGROUND OF THE INVENTION

It is commonplace to install metal flashing where a wall intersects the roof plane. In sloped roofing applications, it is typical for the roof to encounter a wall, such as a dormer. In flat roof installations, many roof systems terminate at a parapet, roof protrusion, or wall.

The roofing industry has typically frowned on second layer roof applications, due to the inability of the next cover roofing system to tie into existing flashing when encountering a wall. The problem is further exacerbated when a wall cover material, such as stucco, siding, or other wall cover, extends over the top edge of the existing wall flashing. To replace the existing wall flashing, the wall cover material needs to be removed and reinstalled or replaced. These steps add time and expense to roof replacement.

Despite the roofing industry's reservations regarding second layer roofing applications, the use and encouragement of second layer roof applications remains desirable, primarily due to cost and environmental impact benefits. Moreover, there is a substantial movement towards shingle recycling and keeping the existing shingles on the roof through another roofing cycle, as more communities come on board with shingle recycling efforts. Suffice it to say that, second layer applications are cleaner, while saving the owner money and the roofing contractor time.

What is needed, therefore, is flashing that can be used in second layer roofing applications that is able to tie into existing flashings when encountering a wall, without removal and/or replacement of the existing flashing.

SUMMARY OF THE INVENTION

A roof wall flashing comprising a cavity suitable for second layer recoverability that is built into the flashing itself allows for tying into existing flashing when encountering a wall without removal and/or replacement of existing flashing.

DETAILED DESCRIPTION

Figure 1:
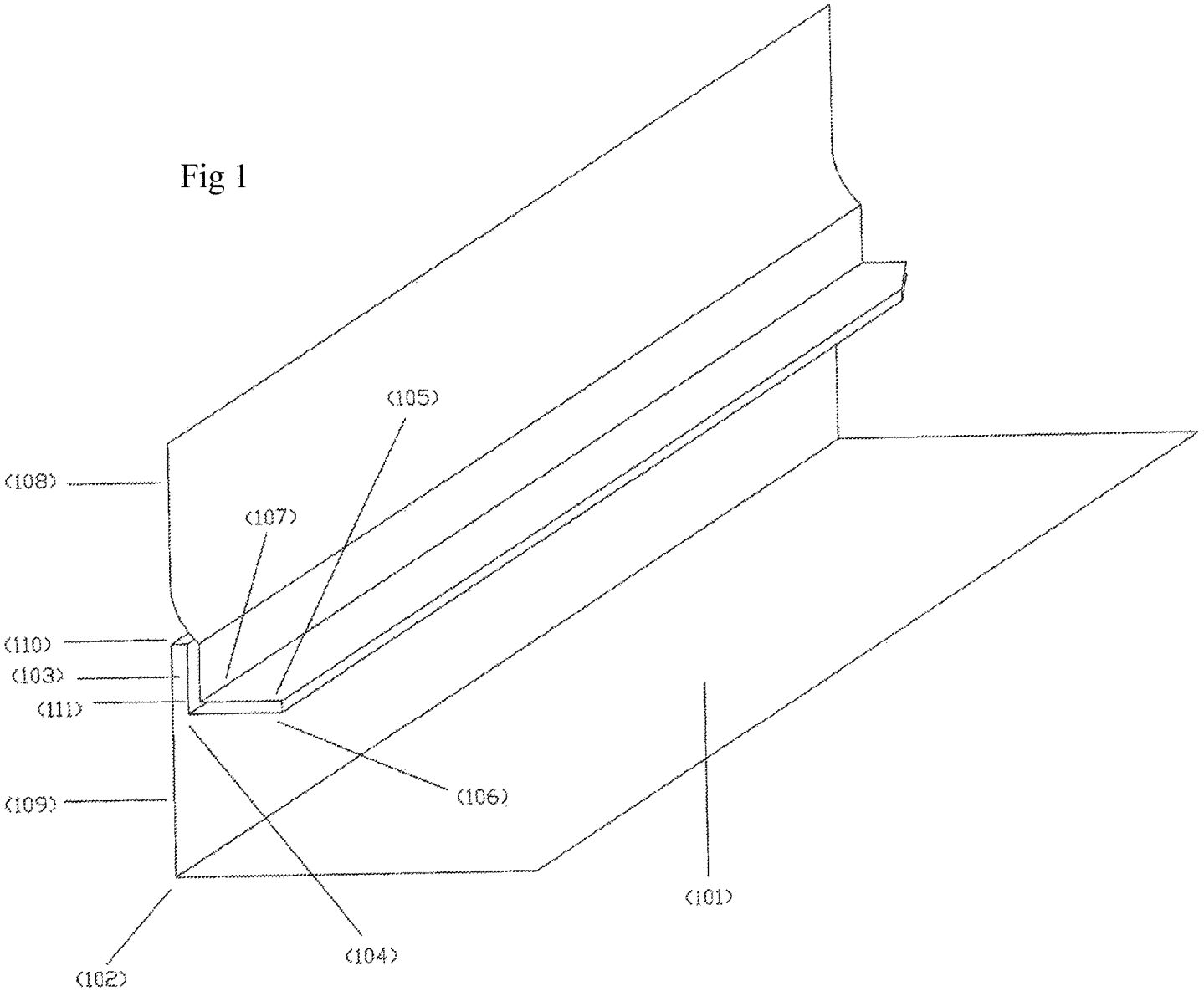
FIG. 1 is a double coverage roof wall flashing comprising a cavity and ledge, configured in accordance with the embodiments of the present invention.

One embodiment of the present invention, as shown in FIG. 1, provides a base flashing 101 designed to sit on a roof surface and a wall flashing 109 designed to abut a wall the intersects the plane of a roof. In the case of the roof surface and wall to be flashed being perpendicular to one another, the interior angle 102 created between the base flashing 101 and wall flashing 109 is approximately 90 degrees. Otherwise the base flashing 101 and wall flashing may be bent to match the angle created by the roof and wall to be flashed.

The wall flashing 109 is designed to extend up a vertical wall before returning onto itself, forming a living hinge 110 while also creating a cavity 103. The inner portion of the hinge 111 is further bent approximately 90 degrees 104 away from the wall flashing 109, resulting in it extending away from the wall flashing 109 perpendicularly, before being folded back on itself, resulting in a closed hem 106 that forms a ledge 105. The material forming the ledge 105 is then further bent upwards at approximately a 90 degree angle 107 and, after extending upwards until it is substantially level with the top portion of wall flashing 109, is angled slightly rearwards until it meets the plane defined by the wall flashing 109 and is subsequently angled once again to remain substantially within the plane defined by the wall flashing 109, forming upper wall flashing.

The ledge 105 created by the closed hem 106 may, in embodiments, be biased towards the wall through a spring effect or hinge, which can be created by virtue of the flashing's construction, through the use of special materials and/or alloys, and in other ways, as would be known to those of ordinary skill in the art.

In embodiments, the ledge 105 may be formed above or below a topmost portion of the wall flashing 109. The ledge 105 may also be bent further from the roof plane than 90 degrees, depending on the siding being installed, so as to further compress the cavity 103, due to the weight of the siding material installed. In addition, the ledge 105 may be designed such that the weight of the siding causes it to become parallel to the roof surface following installation. The ledge 105 may also be bent closer to the roof plane to provide for water discharge off of the ledge.

The installation of siding, stucco or the other exterior wall products onto the ledge allows the hinge 110 of the flashing to act like a spring by compressing the cavity 103 thereby further securing flashings installed at the interface between the wall flashing 109 and the inner portion of the hinge 111, which form the cavity 103.

In another embodiment of the present invention, the ledge is eliminated, but the cavity 201 remains and is built into the flashing itself, allowing for second layer recoverability. In this embodiment, the base flashing 202 extends onto the roof surface and is bent at a 90 degree angle 203, becoming wall flashing 204. In other embodiments, the base flashing 202 and wall flashing 204 may be bent to match the angle created by the roof and wall to be flashed. The wall flashing 204 then extends upwards, in use along a vertical wall, before doubling back onto itself, towards the base flashing 202, creating a hinge 209 and a cavity 201. At a certain point, the inner portion of the hinge, which could also be construed as the outer portion of the cavity, again doubles back onto itself, forming a vertically-oriented closed hem 205 that is substantially parallel to the wall flashing 204. Regarding the material forming the closed hem 205, after extending upwards until it is substantially level with a top portion of wall flashing 204, it is then angled slightly rearwards until it meets the plane defined by the wall flashing 204 and is subsequently angled once again to remain substantially within the plane by the wall flashing 109, forming upper wall flashing 207.

The point 206 of the closed hem 205 creates a continuous straight line 208 that siding materials can follow, proving for a clean, finished siding starting point and edge.

The cavity of each embodiment (103 and 201) provides protection to the top edge of future flashings. After completion of the second layer roof, the closed hem 205 of the embodiment shown in FIG. 2 may be fastened to a wall, securing second layer flashing installed during a roofing repair or re-roofing process.

In embodiments, the flashing is tapered step flashing that accounts for the width of the shingles to be used, thereby maintaining a straight profile of the ledge 105, closed hem 106, the point 206, and the cavity (103 and 201). The flashing with a cavity (103 and 201) may be fabricated to any length that may be needed or required by local building codes.

For sloped roof applications, the step flashing with cavity or continuous flashing with cavity should be installed commencing towards the eave and working towards the ridge for proper overlap and watershed. On flat roof applications, the starting location of the installation of the flashing is not generally important, however, on flat roof applications, a sealant should be installed at the overlap of the wall flashing (204 and 207) sections and the sections may be secured to the wall through the closed hem 205.

In embodiments, the double coverage flashing is installed along a wall during an initial roofing process. While the benefit of the cavity (103 and 201) may not be apparent during the initial roofing, it will become evident when the roof needs to be replaced or serviced. More specifically, if repair or retrofitting of an existing roofing system constructed in accordance with such embodiments is required, it now becomes possible, without removing existing wall cover material and roofing.

Additionally, a roofing underlayment may be installed along the roof surface and up the vertical incline, followed by the disclosed double coverage flashing. At such a time when a second layer roof is installed, step flashing or wall flashing may then be inserted into the cavity (103 and 201).

Furthermore, the joining of one section of flashing to the next using a notch is important to ensure a continuous cavity is formed therebetween. To achieve such fitment, the closed hem (106 and 205) of embodiments may be notched when joining one section to the next. More specifically, the closed hem (106 and 205) disclosed herein may be notched to provide for a seamless look, metal overlap, and to expose the cavity (103 and 206) without interference of an overlap, which would prevent any subsequent flashing from being installed seamlessly.

In embodiments, the notch is made on-site using tin snips, while, in other embodiments, the notch may be formed during the manufacturing process.

Figure 2:
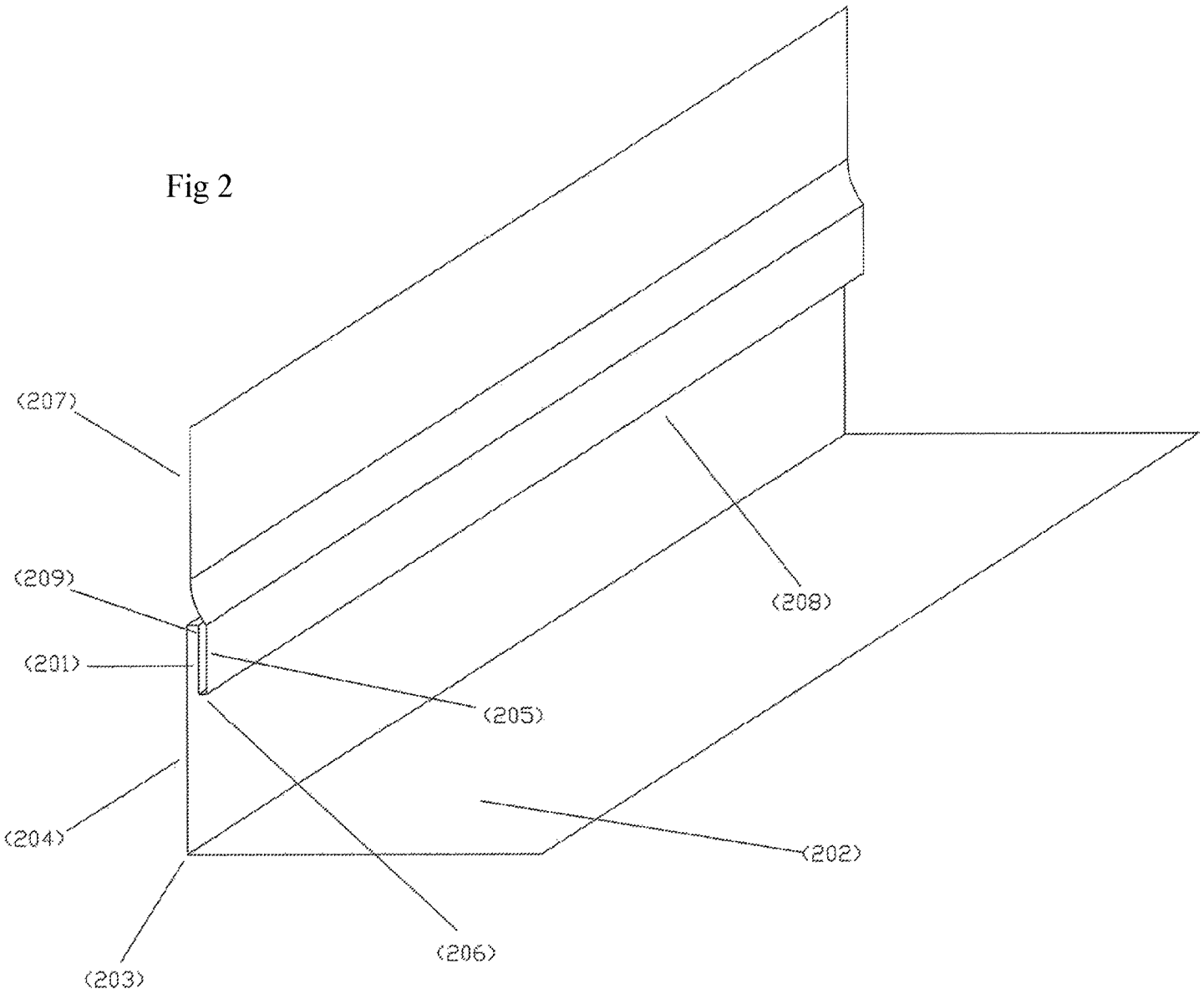
FIG. 2 is a double coverage roof wall flashing with a cavity and closed hem, configured in accordance with embodiments of the present invention.

The placement of the notch is very important to achieving the proper overlap. The notched section of the flashing may be the top side facing towards the ridge on sloped roof applications. As such, in FIG. 1, the material removed to provide for proper overlap on metal sections would be as follows: remove metal on the bottom of closed hem 106 and metal from the inner portion of the hinge 111 to create a notch. The disclosure as depicted in FIG. 2 should have the following material removed from metal sections thereof to provide for proper overlap: remove metal from the closed hem 205 closest to the wall flashing 204 from the point 206 to the hinge 210 and along the straight line 208. While these locations are preferred, others may be used, as would be known to one of ordinary skill in the art.

In embodiments, the flashing is folded or gaped at the time of fabrication. The notch or fold, including expansion or gaping of metal sections via the use of specialty machinery, permits for the elimination of a notch and allows sections of the flashing disclosed herein to connect in a seamless manner.

Furthermore the flashing disclosed herein, in embodiments, is fabricated without the base flashing (101 and 202). Using such embodiments, the flashing may be installed onto custom fabricated or stock flashings as an additional piece, thereby providing for the future benefits of the cavity without changing the way systems are installed today.

The flashing disclosed herein is, most preferably, fabricated using a metal break of roll former, although other methods could be used, as would be known to one of ordinary skill in the art. The source material, typically metal, may be obtained in flat sheets or in roll form and be slit to the desired width prior to fabrication.

Materials, especially metals, are offered in a variety of gauges and mils, depending on local codes and performance requirements. The dimensions of the gap and the fabricated widths can vary from site to site, depending on the roofing system being installed and site conditions discovered prior to fabrication.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A double coverage roof wall flashing comprising:

a base portion configured to rest against a roof surface following installation on a building envelope;

a wall portion configured to abut and be secured to a wall following installation on the building envelope;

a vertically-oriented closed hem positioned adjacent to said wall portion and spaced apart therefrom;

a substantially horizontally-oriented closed hem positioned at a distal portion of said vertically-oriented closed hem and extending away from said wall portion; and an upper wall portion extending vertically from said substantially horizontally-oriented closed hem and configured to abut and be secured to a wall following installation on the building envelope;

wherein said vertically-oriented closed hem is substantially parallel to said wall portion and configured to form a cavity large enough to accommodate at least one subsequent layer of flashing therebetween, wherein said substantially horizontally-oriented closed hem forms a ledge, and wherein said ledge is configured to accommodate siding materials on a top side thereof and to flex and thereby narrow said cavity upon the placement of siding materials thereon.

2. The double coverage roof wall flashing of claim 1 wherein the internal angle formed between said base portion and said wall portion is 90 degrees.

3. The double coverage roof wall flashing of claim 1 wherein the internal angle formed between said base portion and said wall portion is configured to allow it to be bent by hand to match an angle created between a roof and wall to be flashed.

4. The double coverage roof wall flashing of claim 1 wherein the upper wall portion extends upwards from said ledge until it is substantially level with a top of the wall portion, then angles slightly rearwards until it meets a plane defined by the wall portion, before finally being angled once again to remain substantially within the plane defined by the wall portion.

5. The double coverage roof wall flashing of claim 1 wherein said ledge is configured such that the weight of a siding material placed thereon causes it to sag such that it becomes parallel to the roof surface following installation.

6. The double coverage roof wall flashing of claim 1 wherein said cavity is thick enough to accommodate flashing therein while being thin enough to allow expected flexing of the ledge to impart pressure thereon to help retain said flashing.

7. The double coverage roof wall flashing of claim 1 wherein said double coverage roof wall flashing is step flashing.

8. The double coverage roof wall flashing of claim 1 further comprising at least one notch configured to allow subsequent sections of flashing to form a continuous cavity therebetween.

9. The double coverage roof wall flashing of claim 1 wherein the terminal ends of said flashing are expanded such that subsequent sections of flashing form a continuous cavity therebetween.

10. The double coverage roof wall flashing of claim 1 wherein the terminal ends of said flashing are gaped such that subsequent sections of flashing form a continuous cavity therebetween.

11. The double coverage roof wall flashing of claim 1 wherein said flashing is made of metal.

12. A double coverage roof wall flashing comprising:

a wall portion configured to abut and be secured to a wall following installation on the building envelope;

a vertically-oriented closed hem positioned adjacent to and spaced apart therefrom said wall portion;

a substantially horizontally-oriented closed hem positioned at a distal portion of said vertically-oriented closed hem and extending away from said wall portion; and an upper wall portion extending vertically from said a substantially horizontally-oriented closed hem and configured to abut and be secured to a wall following installation on the building envelope;

wherein said vertically-oriented closed hem is substantially parallel to said wall portion and configured to form a cavity large enough to accommodate at least one subsequent layer of flashing therebetween, wherein said substantially horizontally-oriented closed hem forms a ledge, and wherein said ledge is configured to accommodate siding materials on a top side thereof and to flex and thereby narrow said cavity upon the placement of siding materials thereon.

* * * * *